US007462787B1

(12) United States Patent
Kang et al.

(10) Patent No.: US 7,462,787 B1
(45) Date of Patent: Dec. 9, 2008

(54) ROTARY MANIPULATION TYPE INPUT DEVICE

(75) Inventors: Eung-Cheon Kang, Hwaseong-si (KR); Sang-Jin Lee, Seoul (KR)

(73) Assignee: Samsung Electro-Mechanics Co., Ltd., Suwon (KR)

( * ) Notice: Subject to any disclaimer, the term of this patent is extended or adjusted under 35 U.S.C. 154(b) by 0 days.

(21) Appl. No.: 12/213,463

(22) Filed: Jun. 19, 2008

(30) Foreign Application Priority Data

Dec. 26, 2007 (KR) ..... 10-2007-0137796

(51) Int. Cl.
*H01H 9/00* (2006.01)

(52) U.S. Cl. ..... 200/4; 200/5 R; 200/14

(58) Field of Classification Search ..... 200/4, 200/5 R, 6 A, 17 R, 18, 14; 341/20, 35; 345/156, 345/157, 159–161, 184; 335/205–207
See application file for complete search history.

(56) References Cited

U.S. PATENT DOCUMENTS 5,952,628 A * 9/1999 Sato et al. ..... 200/4
6,003,367 A * 12/1999 Bux et al. ..... 73/462
6,124,555 A * 9/2000 Isikawa ..... 200/4
6,184,480 B1 * 2/2001 Nishimoto et al. ..... 200/4
6,225,980 B1 * 5/2001 Weiss et al. ..... 345/161
6,369,692 B1 * 4/2002 Van Zeeland ..... 338/200
6,720,504 B2 * 4/2004 Nishimoto et al. ..... 200/4
6,864,679 B2 * 3/2005 Yokoji et al. ..... 324/207.11
7,091,430 B1 * 8/2006 Haizima et al. ..... 200/6 A
7,297,882 B2 * 11/2007 Badarneh ..... 200/5 R
7,342,187 B2 * 3/2008 Yamaguchi ..... 200/14
7,352,174 B1 * 4/2008 Lee ..... 324/207.25

* cited by examiner

*Primary Examiner*—Michael A Friedhofer

(57) ABSTRACT

A rotary manipulation type input device is disclosed. The rotary manipulation type input device may include: a wheel, which may receive information as input by rotation; a sensor unit, which may sense a rotation of the wheel; and a switch, which may generate an on/off signal for connecting and disconnecting a power supply to the sensor unit. This configuration can be used to reduce power consumption in the rotary manipulation type input device.

6 Claims, 7 Drawing Sheets

ROTARY MANIPULATION TYPE INPUT DEVICE

CROSS-REFERENCE TO RELATED APPLICATIONS

This application claims the benefit of Korean Patent Application No. 10-2007-0137796 filed with the Korean Intellectual Property Office on Dec. 26, 2007, the disclosure of which is incorporated herein by reference in its entirety.

BACKGROUND

1. Technical Field

The present invention relates to a rotary manipulation type input device.

2. Description of the Related Art

An inputting apparatus, such as a remote control, may generally include the numbers 0 to 9 and the symbols * and # on a keypad of 12 keys. In addition to the numbers, there may also be alphabet letters as well as consonants and vowels of other local languages marked on such a keypad, to enable the input of information including numbers and text, etc. A product may also include a navigation key formed above the keypad equipped with a variety of functions.

There are various forms navigation keys, including button types and rotational types, etc., but the use of rotary manipulation type input device is currently increasing, as they maximize user convenience and enable various functions.

In order that the rotation of the wheel is sensed immediately when a user rotates the wheel, the rotary manipulation type input device may always have the rotation sensor, such as a Hall sensor, etc., ready for input. As such, the rotary manipulation type input device may always require a certain level of power consumption, and in a rotary manipulation type input device that uses a miniature power supply such as a battery, etc., a user may be inconvenienced with having to frequently replace or recharge the battery.

SUMMARY

An aspect of the invention provides a rotary manipulation type input device in which power consumption can be minimized.

Another aspect of the invention provides a rotary manipulation type input device that includes: a wheel, which may receive information as input by rotation; a sensor unit, which may sense a rotation of the wheel; and a switch, which may generate an on/off signal for connecting and disconnecting a power supply to the sensor unit.

Here, the switch can be a dome switch that includes multiple contact points, where the multiple contact points can include a first contact point, which may generate a power supply signal for the sensor unit, and a second contact point, which may receive the information to generate an operation signal for the sensor unit. The first contact point can be formed on either side of the dome switch, while the second contact point can be formed in a middle of the dome switch. The dome switch can be positioned such that the dome switch may be pressed by the wheel.

The rotary manipulation type input device can further include a magnet coupled to the wheel, in which case the sensor unit can include a Hall sensor that senses changes in a magnetic field of the magnet.

Additional aspects and advantages of the present invention will be set forth in part in the description which follows, and in part will be obvious from the description, or may be learned by practice of the invention.

DETAILED DESCRIPTION

Figure 1:
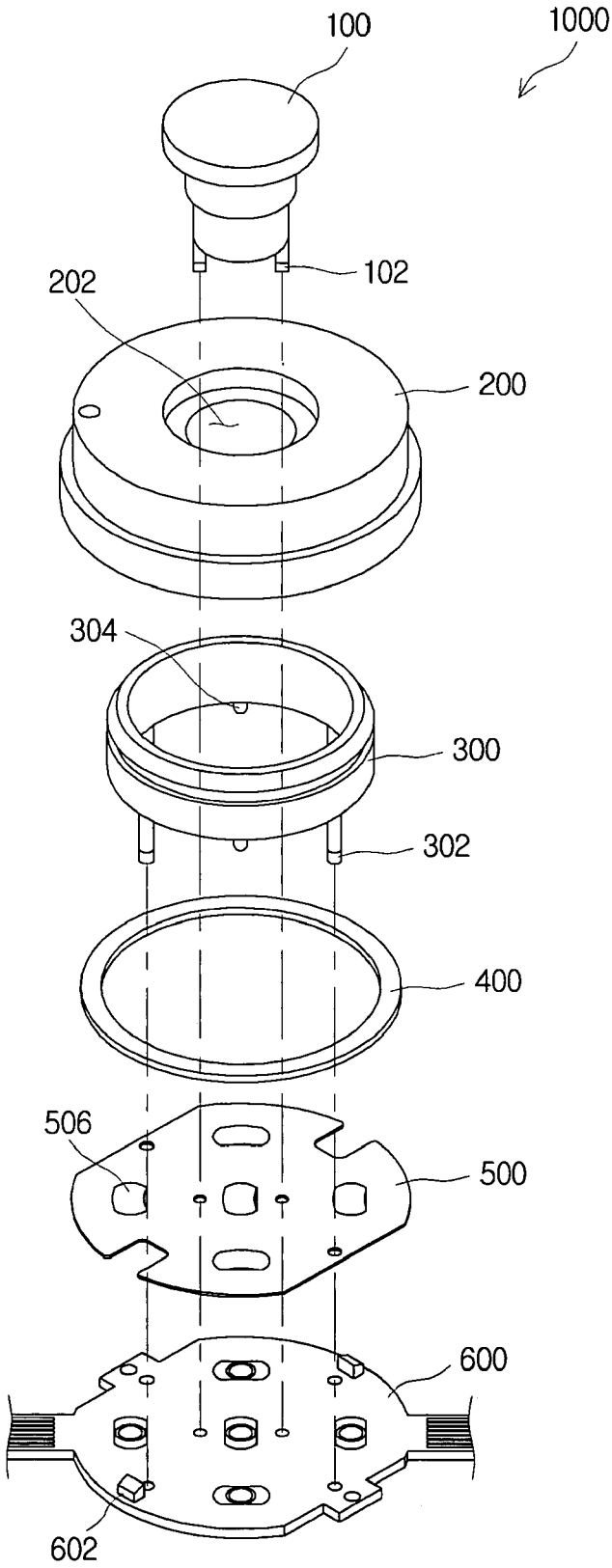
FIG. 1 is an exploded perspective view of a rotary manipulation type input device based on an embodiment of the invention.

The rotary manipulation type input device based on certain embodiments of the invention will be described below in more detail with reference to the accompanying drawings. Those components that are the same or are in correspondence are rendered the same reference numeral regardless of the figure number, and redundant explanations are omitted.

Figure 2:
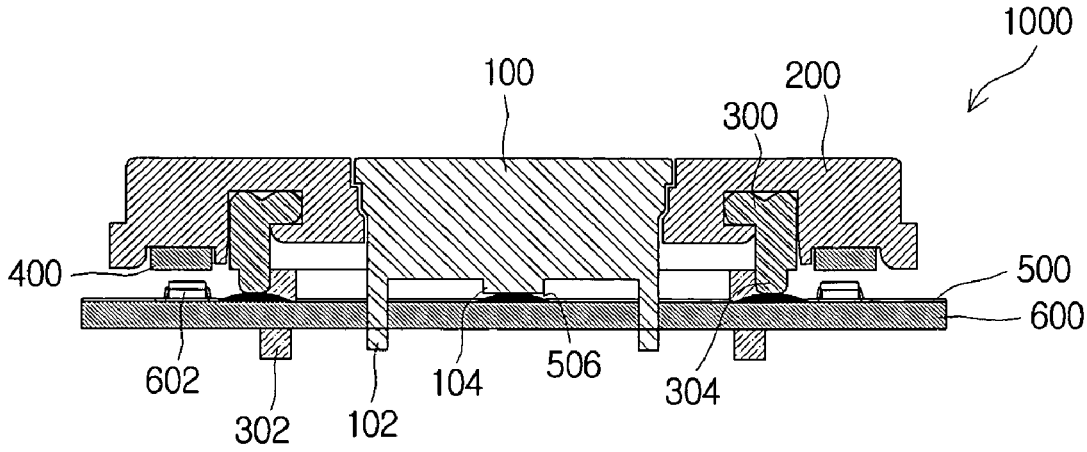
FIG. 2 is a cross sectional view of a rotary manipulation type input device based on an embodiment of the invention.
Figure 3:
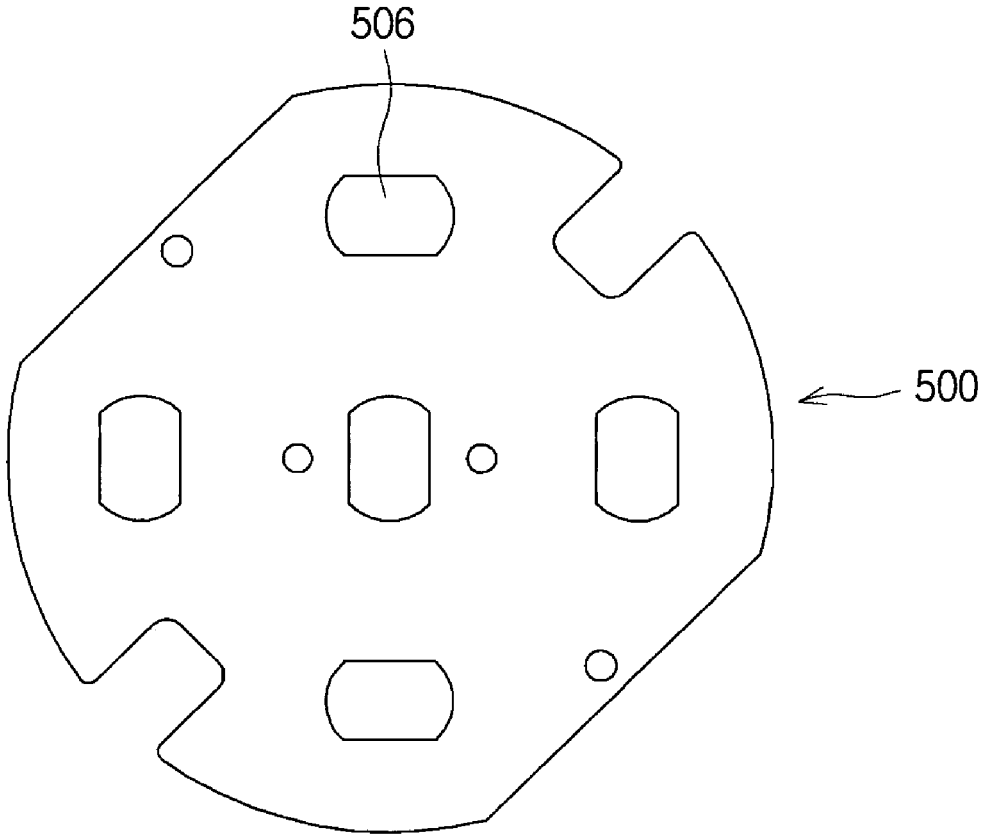
FIG. 3 is a plan view of a dome sheet based on an embodiment of the invention.
Figure 4:
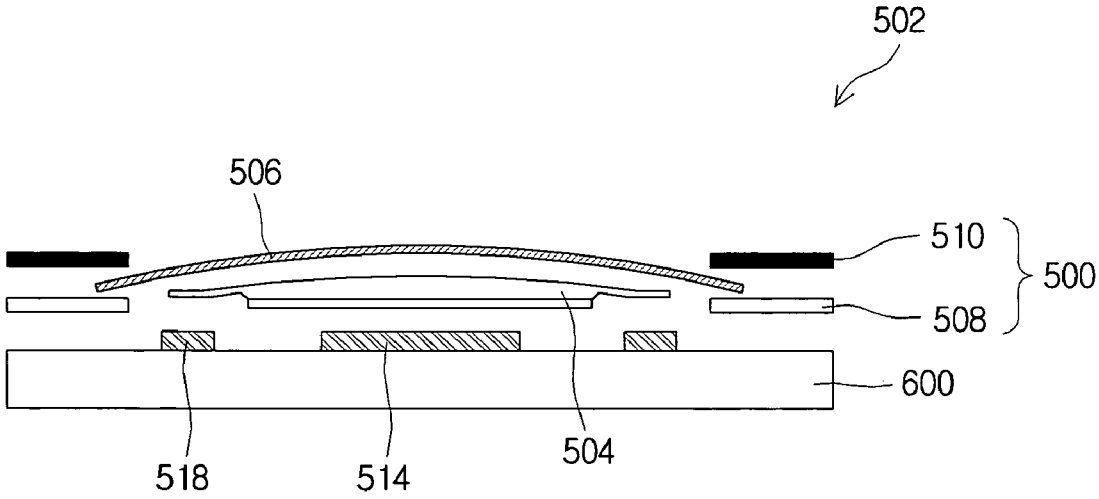
FIG. 4 is a cross sectional view of a dome sheet based on an embodiment of the invention.
Figure 5:
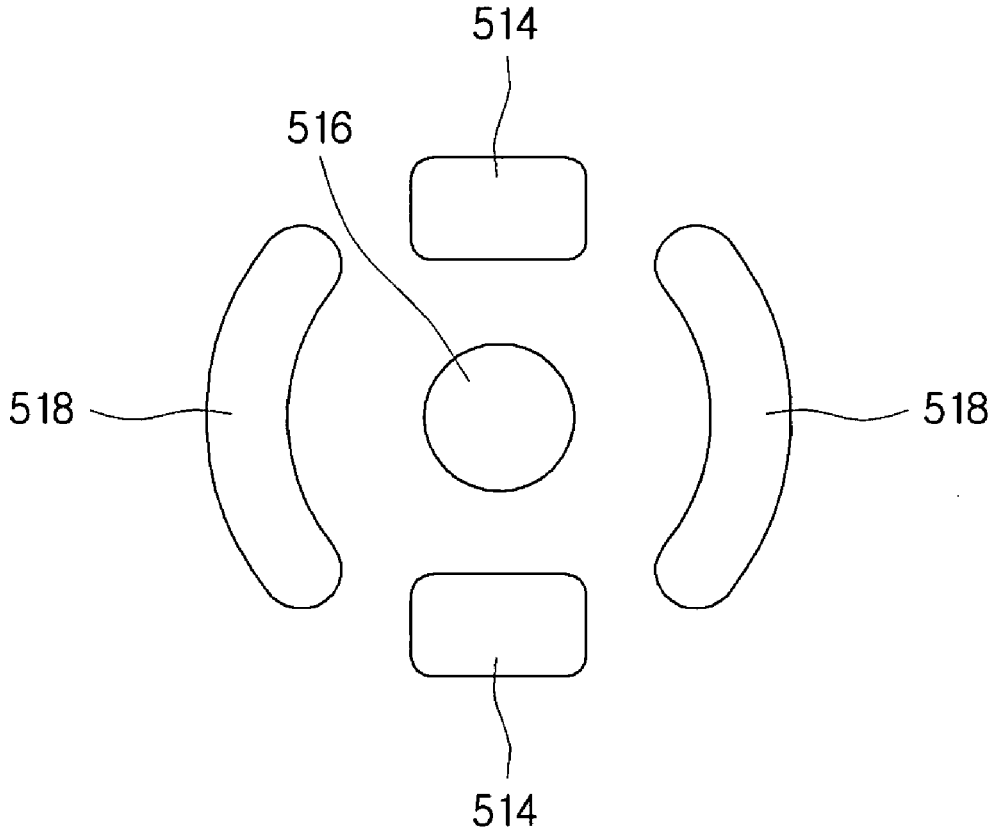
FIG. 5 is a plan view of contact points based on an embodiment of the invention.
Figure 6:
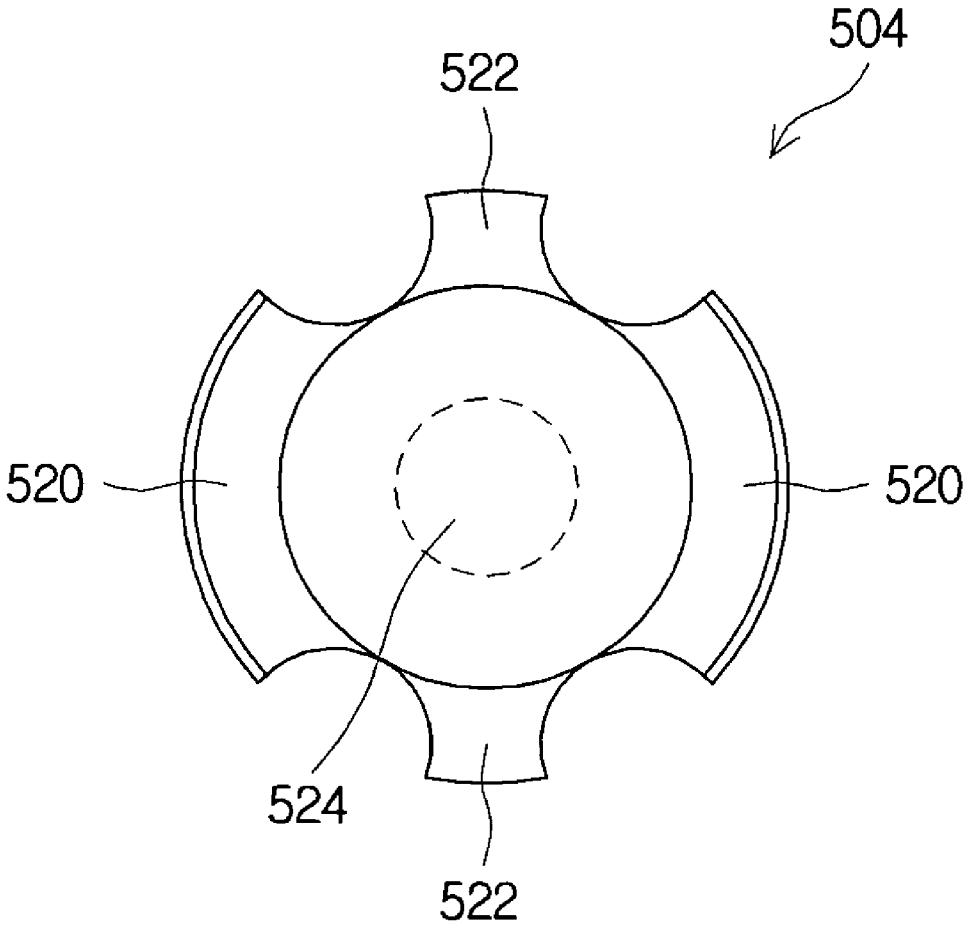
FIG. 6 is a plan view of a metal dome based on an embodiment of the invention.
Figure 7:
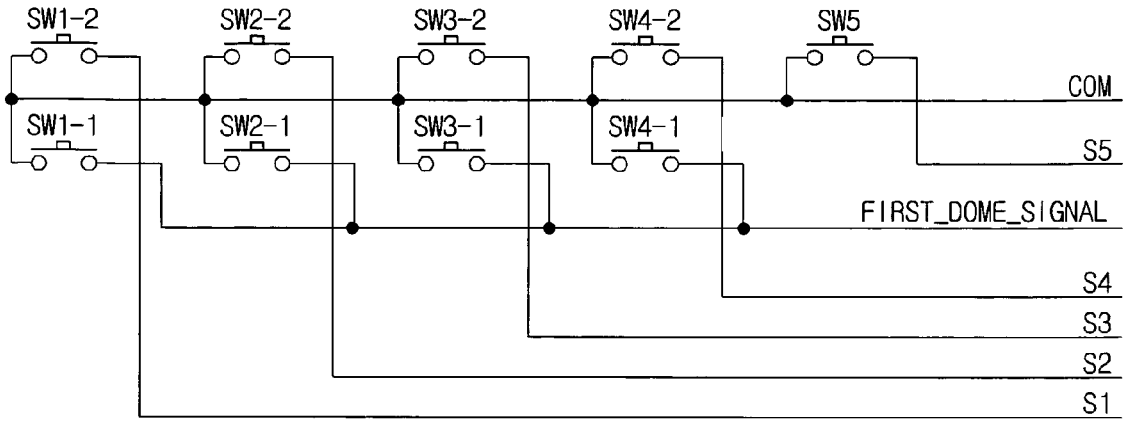
FIG. 7 is a circuit diagram illustrating the electrical connections in a dome sheet based on an embodiment of the invention.

FIG. 1 is an exploded perspective view of a rotary manipulation type input device based on an embodiment of the invention, and FIG. 2 is a cross sectional view of a rotary manipulation type input device based on an embodiment of the invention. FIG. 3 is a plan view of a dome sheet based on an embodiment of the invention, and FIG. 4 is a cross sectional view of a dome sheet based on an embodiment of the invention. FIG. 5 is a plan view of contact points based on an embodiment of the invention, and FIG. 6 is a plan view of a metal dome based on an embodiment of the invention. Also, FIG. 7 is a circuit diagram illustrating the electrical connections in a dome sheet based on an embodiment of the invention.

In FIG. 1 to FIG. 7, there are illustrated a center button 100, detent protrusions 102, a wheel 200, a through-hole 202, a holder 300, securing protrusions 302, push protrusions 104, 304, a magnet 400, a dome sheet 500, dome switches 502, a metal dome 504, a top tape 506, a base tape 508, an EMI shielding 510, first contact points 514, a second contact point 516, support points 518, support portions 520, flange portions 522, a center portion 524, a printed circuit board 600, Hall sensors 602, and a rotary manipulation type input device 1000.

As illustrated in FIGS. 1 and 2, a rotary manipulation type input device 1000 based on an embodiment of the invention can include a wheel 200, which may receive input by rotation; a sensor unit, which may sense a rotation of the wheel 200; and a switch, which may generate an on/off signal for connecting and disconnecting a power supply to the sensor unit. This configuration can be used to reduce power consumption in the rotary manipulation type input device 1000.

A rotary manipulation type input device based on this embodiment can be installed in an input unit of an electronic device, such as a remote control and a cell phone, etc., to receive information as input, and can also be coupled with a control unit of the electronic device for operation. This embodiment will be described, using an example in which the rotary manipulation type input device is coupled with such a control unit for operation.

The wheel 200 is the portion that receives information as input by rotation. The wheel 200 can be rotatably supported by a holder 300. A user may input certain information by rotating the wheel 200. Here, the information can include commands for requesting particular operations of the electronic device to which the rotary manipulation type input device 1000 is installed, and for moving and making selections in a menu. The user can input such information not only by rotating the wheel 200 but also by pressing certain buttons.

A through-hole 202 may be formed in the center of the wheel 200 through which a center button 100 may be inserted. The center button 100 can have detent protrusions 102 formed on a bottom surface that may be inserted in and secured to a printed circuit board 600. The user can press the center button 100, which may in turn press a dome switch positioned in the center, to thereby allow the input of information.

The holder 300 may support the wheel 200 in a manner that allows rotation. Securing protrusions 302, for example, formed on the bottom surface of the wheel 200, can be inserted through the printed circuit board 600 to secure the holder 300. Push protrusions 304 can be formed on the bottom surface of the wheel 200, so that when the user presses the wheel 200, a push protrusion 304 formed in a corresponding position may press an opposing dome switch, and thereby allow the input of information.

A magnet 400 can be coupled to a bottom surface of the wheel 200. When the user rotates the wheel 200, Hall sensors 602 facing the wheel 200 can sense the changes in the magnetic field effected by the magnet 400. In this way, the Hall sensors 602 can recognize the rotation of the wheel 200 and thus allow the input of information.

The sensor unit is the part that senses the rotation of the wheel 200. The sensor unit can include Hall sensors 602, which sense changes in the magnetic field of the magnet 400. The Hall sensor 602 can be coupled onto both sides of the printed circuit board 600 in positions facing the magnet 400. The Hall sensors may thus sense changes in the magnetic field of the magnet 400 and transmit corresponding electrical signals, so that rotations of the wheel 200 can be detected.

The switch can generate on/off signals to connect and disconnect the power supply to the sensor unit. In sensing the rotation of the wheel 200, the Hall sensors 602 may consume power even when the wheel 200 is not being rotated. In the rotary manipulation type input device 1000 based on this embodiment, the control unit (not shown) of the electronic device, to which the rotary manipulation type input device 1000 is coupled, can disconnect the power supply to the Hall sensors 602 when the rotary manipulation type input device 1000 is not being used, so that the amount of power consumed can be reduced. The on/off signal can be of a particular voltage or a particular current supplied or not supplied from the control unit, according to whether or not the switch provides an electrical connection, so that the control unit may connect or disconnect the power supply to the sensor unit.

The switch can be formed as dome switches 502 that include a multiple number of contact points. As illustrated in FIGS. 3 and 4, the dome switches 502 can be arranged in positions corresponding with the push protrusions 104, 304 of the center button 100 and the holder 300, in the form of a sheet and contact points facing the sheet. This sheet may be referred to as a dome sheet 500. The dome switch 502 formed in the center of the dome sheet 500 can be pressed by the push protrusion 104 of the center button 100 to receive information as input, while the surrounding dome switches 502 can be pressed by the push protrusions 304 of the holder 300 to receive information as input. Each push protrusion 104, 304 can generate a corresponding signal.

As illustrated in FIG. 4, the dome sheet 500 can include a metal dome 504, a top tape 506 covering the metal dome 504, a base tape 508 supporting the top tape 506, and an EMI (electromagnetic interference) shielding 510 covering the base tape 508. A dome switch 502 can include contact points and the dome sheet 500 covering the contact points, and can be pressed by a push protrusion 104, 304 to receive input and generate a corresponding signal.

As illustrated in FIG. 5, the multiple contact points can include first contact points 514, which may be formed on both sides of a dome switch 502 and which may generate a power supply signal, as well as a second contact point 516, which may receive information as input and generate an operation signal. The dome switches 502 can be arranged below the wheel 200, and can be pressed by push protrusions 304 arranged on the wheel 200. A power supply signal can be a signal transferred to the control unit when an electrical connection is implemented at a first contact point. The control unit may receive the power supply signal and accordingly supply power to the sensor unit.

As illustrated in FIG. 6, the support portions 520 of the metal dome 504 can be supported by support points 518. When the user presses down on the metal dome 504, the flange portions 522 formed on both sides of the metal dome 504 may first touch the first contact points 514.

The pressure needed to cause a first contact point 514 to generate a power supply signal can be adjusted. For example, the required pressure can be set to the amount of pressure applied when the user touches the wheel 200 to rotate the wheel 200, so that the user may cause the first contact points 514 to generate a power supply signal without feeling that a separate pressing action is necessary. The power supply signal can be transferred to the control unit, at which the control unit can supply power to the sensor unit.

As the user further presses down on the metal dome 504, the center portion 524 of the metal dome 504 may touch the second contact point 516. As the second contact point 516 receives input and generates an operation signal in the dome switch 502, the user is enabled to input information requiring an operation, such as making a menu selection, for example, in the electronic device in which the rotary manipulation type input device 1000 is installed. The operation signal can be a signal corresponding to the information mentioned above. In order to implement the operation, the control unit may transmit a signal to the relevant part or may perform the operation itself.

The pressure needed to cause the center portion 524 of the metal dome 504 to touch the second contact point 516 can be adjusted. For example, the required pressure can be set such that the user perceives a clicking sensation. Here, the amount of pressure required for providing an electrical connection at the second contact point 516 can be greater than the amount of pressure required for providing an electrical connection at the first contact points 514.

As illustrated in FIG. 7, a dome switch 502 can include two types of contact points, to receive two types of input and generate the corresponding signals. The dome switches 502 on the periphery of the dome sheet 500 can be formed in the dual structure described above, to include first contact points 514 (SW1-1, SW2-1, SW3-1, SW4-1) and second contact points 516 (SW1-2, SW2-2, SW3-2, SW4-2). SW5 can receive as input the information required by the user by way of the center button 100.

If there is no input made for a predetermined duration of time, the control unit can disconnect the power supply to the sensor unit. When the user operates the wheel 200, the power supply can be connected, and the Hall sensors 602 can be turned to a ready mode.

If there is no input of user information made through the wheel 200 or button, etc., the control unit can measure the elapsed time from the latest occurrence of information input, and if a predetermined duration of time has passed, can disconnect the power supply to the Hall sensors 602. In this way, the rotary manipulation type input device 1000 based on this embodiment can disconnect unnecessary power supply during periods of disuse, for savings in power consumption.

While the power supply to the Hall sensors 602 is disconnected, the user may touch the wheel 200 and cause the first contact points 514 and the flange portions 522 to come into contact. That is, one of the switches 502 among SW1-1, SW2-1, SW3-1, and SW4-1 may be turned on. The switch may generate a power supply signal (FIRST_DOME_SIGNAL) and transfer the power supply signal to the control unit, at which the control unit may supply power to the Hall sensors 602. With power supplied to the Hall sensors 602, the Hall sensors 602 can sense the rotation of the wheel 200, so that the user may input information by rotating the wheel 200.

Also, when the user presses one of four directions on the wheel 200 or the center button 100 using an amount of pressure sufficient to turn on the second contact point 516, the second contact point 516 (SW1-2, SW2-2, SW3-2, SW4-2) or SW5 can be turned on. The switch may generate a corresponding operation signal of S1 to S5 and transmit the signal to the control unit, at which the control unit may then implement the corresponding operation. In this way, the user is enabled to input the corresponding information.

As such, a rotary manipulation type input device 1000 based on this embodiment can disconnect power supply to the Hall sensors 602 while the rotary manipulation type input device 1000 is not being used, but can supply power to the Hall sensors 602, so that the rotation of the wheel may be sensed, when the user simply touches the wheel 200. In this way, the power consumption in the rotary manipulation type input device 1000 can be reduced.

While the spirit of the invention has been described in detail with reference to particular embodiments, the embodiments are for illustrative purposes only and do not limit the invention. It is to be appreciated that those skilled in the art can change or modify the embodiments without departing from the scope and spirit of the invention.

What is claimed is:

1. A rotary manipulation type input device comprising:

a wheel configured to receive information as input by rotation;

a sensor unit configured to sense a rotation of the wheel; and a switch configured to generate an on/off signal for connecting and disconnecting a power supply to the sensor unit.

2. The rotary manipulation type input device of claim 1, wherein the switch is a dome switch comprising a plurality of contact points.

3. The rotary manipulation type input device of claim 2, wherein the plurality of contact points comprise a first contact point and a second contact point, the first contact point configured to generate a power supply signal for the sensor unit, and the second contact point configured to receive the information and generate an operation signal for the sensor unit.

4. The rotary manipulation type input device of claim 3, wherein the first contact point is formed on either side of the dome switch, and the second contact point is formed in a middle of the dome switch.

5. The rotary manipulation type input device of claim 2, wherein the dome switch is configured to be pressed by the wheel.

6. The rotary manipulation type input device of claim 1, further comprising:

a magnet coupled to the wheel, wherein the sensor unit comprises a Hall sensor, the Hall sensor configured to sense changes in a magnetic field of the magnet.

* * * * *